United States Patent [19]

Miller

[11] Patent Number: 4,558,251

[45] Date of Patent: Dec. 10, 1985

[54] IMAGE PICKUP ASSEMBLY

[75] Inventor: Louis D. Miller, Leola, Pa.

[73] Assignee: RCA Corporation, Princeton, N.J.

[21] Appl. No.: 192,361

[22] Filed: Sep. 30, 1980

[51] Int. Cl.[4] ..... H01J 31/00

[52] U.S. Cl. ..... 313/365; 313/477 R

[58] Field of Search ..... 313/477, 365, 364; 220/2.1 A

[56] References Cited

U.S. PATENT DOCUMENTS

| | | | |
|---|---|---|---|
| 4,039,986 | 8/1977 | Nakazawa et al. | 335/212 |
| 4,191,936 | 3/1980 | Colgan | 335/210 |
| 4,304,586 | 12/1981 | Vrijssen et al. | 313/482 X |

FOREIGN PATENT DOCUMENTS

| | | | |
|---|---|---|---|
| 2231627 | 1/1973 | Fed. Rep. of Germany | 313/365 |

OTHER PUBLICATIONS

German patent application abstract 2,937,370, published as Dutch application 78-07756 on Jul. 20, 1978.

*Primary Examiner*—David K. Moore

*Attorney, Agent, or Firm*—Eugene M. Whitacre; Dennis H. Irlbeck; Vincent J. Coughlin, Jr.

[57] ABSTRACT

An improved image pickup tube has an insulating envelope with precisely formed inside and outside surfaces. The inside surface of the envelope has a diameter the midpoint of which lies on a longitudinally extending first mechanical axis. An electron gun is aligned with the first mechanical axis. The precisely formed outside surface of the envelope is substantially coaxial with the inside surface. The outside surface has a diameter the midpoint of which lies on a second mechanical axis that is substantially coincident with the first mechanical axis and the optical axis.

2 Claims, 2 Drawing Figures

IMAGE PICKUP ASSEMBLY

BACKGROUND OF THE INVENTION

The present invention relates to an image pickup assembly and more particularly to a pickup tube for such a device in which the inside and outside diameters of the pickup tube are precisely formed so that the longitudinal mechanical axes defined by the midpoints of the respective inside and outside diameters of the tube coincide with the electron optical axis of the tube.

The operation of an image pickup tube requires the focusing and deflection of an electron beam. For this purpose the image pickup tube is provided with a coil assembly including a focusing coil and a deflection coil. The image pickup tube is centered in the coil assembly to form an image pickup assembly.

It is known that the geometrical distortion of an image on the image pickup tube is proportional to the square and the cube of its distance from the central axis of the deflection coil. The axis of the coil must be aligned with the axis of the image pickup tube and the optical axis within close tolerances. The optical axis of the camera and the axis of the coil are aligned with great precision but there is difficulty in aligning the pickup tube with the coil assembly because image pickup tubes are manufactured with glass envelopes having varying wall thicknesses and surface irregularities.

In a color television camera, three image pickup assemblies are usually utilized. If the camera is slightly shocked in handling or if replacement tubes are installed, misregistration, i.e. geometrical distortion in a multi-tubed color camera, will occur. This misregistration adversely affects the quality of the image produced by the color television camera and must be minimized as much as possible.

In U.S. Pat. No. 4,039,986 issued on Aug. 2, 1977 to Nakazawa et al., it is disclosed that misregistration should be suppressed to less than 100 microns. That is, the axis of the coil assembly must be aligned with the axis of the image pickup tube and with the optical axis to a precision of not more than 100 microns. In the first figure of the Nakazawa et al. patent, elastic material, such as gum rubber, is used at two points along the tube (not at the remote ends) for mounting the tube. As illustrated in the second figure of the Nakazawa et al. patent, the elastic material may be embedded in a holder. The elastic material utilized in that patent has a minimum inner diameter that is smaller than the outer diameter of the pickup tube and depends upon the elasticity to absorb the irregularity of the outer diameeter of the pickup tube. These elastic material pieces require a special shape and they are not only expensive to manufactuure but are also difficult to manufacture with high dimensional precision. This lack of precision results in difficulty of alignment of the central axis of the coil assembly with that of the image pickup tube. Further, these elastic members are known to wear and the restoring forces may not completely return, making alignment difficult when replacing a tube or when the camera is shocked in handling. Further, as discussed in the reference, the image pickup device is mounted using O-rings made of elastic material along the length of the tube. These O-rings have essentially the same problems as the other elastic materials. They are difficult to manufacture with high dimensional precision, are known to wear and the restoring forces may not completely return the tube when shocked in handling or when replacing a tube. An added disadvantage of prior solutions is that the tubes are not securely held to prevent axial motion with respect to the yoke. This axial motion will cause focus and alignment problems.

An alternative to the Nakazawa et al. structure is described in U.S. Pat. No. 4,191,936 issued on Mar. 4, 1980 to Colgan. The Colgan patent discloses a structure in which an image pickup tube is rigidly centered and mounted to a coil assembly by an adjustable split-ring clamp of hard plastic material mounted to the coil assembly. The split-ring clamp, when adjusted for mounting, compresses about the periphery of the faceplate or anti-halation disk extension of the tube to thereby provide a rigid mounting between the coil assembly and the tube. The rear portion of the coil assembly includes a yoke with a tapered inner surface. A split-ring wedge is forced between the tube and the rear portion of the yoke to rigidly support and center the rear portion of the tube.

Both the Colgan and the Nakazawa et al. patents disclose structures to retain an image pickup tube within a coil assembly in such a manner as to minimize the inherent eccentricity of the tube rather than to improve the concentricity of the tube itself.

SUMMARY OF THE INVENTION

An improved image pickup tube comprises an insulating envelope having precisely formed inside and outside surfaces. The inside surface of the tube envelope has a diameter, the midpoint of which lies on a longitudinally extending first mechanical axis. An electron generating means within the tube generates an electron beam along said mechanical axis. The precisely formed outside surface of the envelope is substantially coaxial with the inside surface of the envelope. The outside surface has a diameter the midpoint of which lies on a longitudinally extending second mechanical axis which is substantially coincident with the first mechanical axis.

DETAILED DESCRIPTION OF THE PREFERRED EMBODIMENT

Figure 1:
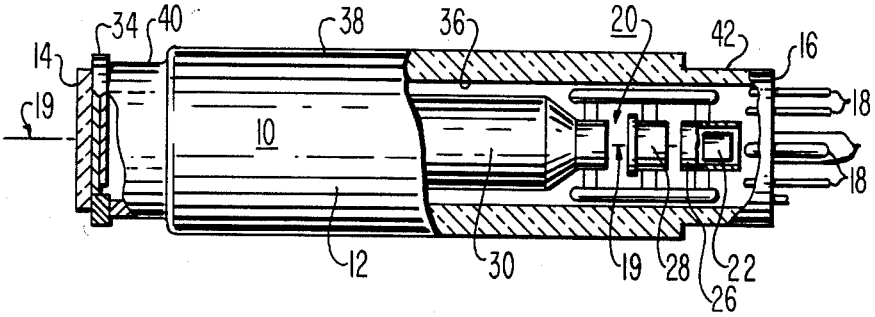
FIG. 1 is a longitudinal side view, partially broken away, of an improved image pickup tube utilizing the novel envelope structure.

Referring to the drawings, there is shown in FIG. 1 a photoconductive image pickup tube 10 of a type commercially known as a vidicon. The tube 10 comprises an evacuated, generally tubular, glass envelope 12 closed at one end by a transparent faceplate 14 and at the other end by a glass stem 16 through which lead-in pins 18 are sealed.

The tube 10 includes a conventional electron gun 20 that is positioned within one end of the envelope 12 substantially on the central longitudinal axis 19 of the tube 10. The electron gun 20 comprises a thermionic cathode 22 for producing an electron beam that is directed toward a target electrode 24 by a control grid 26, an apertured accelerating electrode 28 and a hollow tubular beam focusing electrode, or G3 electrode 30.

The target electrode 24 comprises photoconductive materials, such as silicon, selenium arsenic telluride, lead monoxide or antimony trisulfide, deposited on a film 32 of transparent conductive material such as tin oxide on the faceplate 14. An electrical contact is made to the target 24 by a conductive ring 34 vacuum sealed to envelope 12 and faceplate 14.

The novel envelope 12 comprises an insulating material such as glass or ceramic, however, glass is preferred because of its low cost and ease of fabrication. In the preferred embodiment of FIG. 1, the envelope is made from Corning 7052 glass, available from Corning Glass Co., Corning, N.Y. In order to obtain a precisely formed bulb, heated glass tubing is shrunk by suction on a mandrel (not shown), in a manner well known in the art, until the inside surface 36 of the envelope 12 conforms to the outside surface of the mandrel. The resulting glass cylinder has an inside diameter that can be held to a tolerance of ±0.0254 mm. The midpoint of the inside diameter defines a longitudinally extending first mechanical axis. It is known to "centerless grind" the outside surface of the envelope to form a round cylindrical envelope; however, centerless grinding does not necessarily produce an outside surface having an outside diameter that is concentric with respect to the inside diameter. Consequently, even the best centerless ground prior art envelopes have an inherent eccentricity between the outside diameter and the inside diameter. Since the electron gun 20 is centered with respect to the inside diameter of the envelope 12, the electron optical axis, i.e. the electron beam axis of the centerless ground prior art envelopes, will not coincide with the longitudinally extending second mechanical axis defined by the midpoint of the outside diameter of the envelope.

In the present novel envelope 12, the eccentricity between the outside diameter and the inside diameter of the envelope and consequently between outside diameter of the tube and the optical axis 19 is minimized by shrinking the envelope 12 by suction on the mandrel, as in the prior art, but with the additional step of then grinding the outside surface or central support surface 38 of the envelope 12 to a tolerance of ±0.0254 mm and to an outside diameter that is concentric to the inside diameter to a tolerance of at least 0.0254 mm total indicated readout. The grinding is accomplished by inserting an expanding mandrel into the precisely formed shrunken envelope and then grinding the outside surface 38 relative to the inside surface 36.

As shown in FIG. 1 the precisely ground central support surface 38 of envelope 12 extends along substantially all of the outside surface of the envelope. It is preferred, however, that a faceplate sealing portion 40 and a stem sealing portion 42 be formed at opposite ends of the envelope 12. Sealing portions 40 and 42 each have an outside diameter that is less than the outside diameter of the central support surface 38. For reasons that will be disclosed hereinafter, the smaller outside diameters of the sealing portions 40 and 42 permit the stem 16 and the faceplate 14 to be sealed to the respective sealing portions of the envelope with seals that do not extend beyond the outside diameter of the surface 38. The sealing portions 40 and 42 are not required to have outside diameters concentric with respect to the inside diameter of inside envelope 36.

Figure 2:
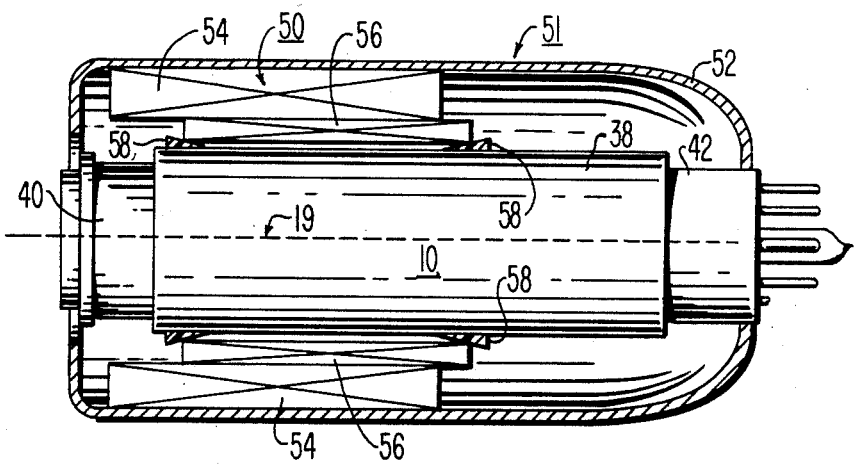
FIG. 2 is a sectional view showing an image pickup assembly according to one embodiment of the present invention.

FIG. 2 shows the image pickup tube 10 and a coil assembly 50 which form an image pickup assembly 51. The coil assembly 50 includes an electromagnetic shield 52, focus coils 54 and deflection coils 56. The coil assembly 50 is generally cylindrical and has an aperture therethrough which closely conforms to the precisely formed surface 38 of pickup tube 10. In the preferred embodiment the inside diameter of the coil assembly 50 should exceed the diameter surface 38 by about 0.0254 mm or less. The coil assembly 50 may be similar to the coil assembly described in the aforementioned Colgan patent. Since the faceplate seal and the stem seal on the sealing portions 40 and 42, respectively, have diameters less than the outside diameter of the central support surface 38, the tube 10 may be inserted into the coil assembly 50. The pickup tube 10 is secured within the coil assembly 50 with an epoxy resin or equivalent material that can be removed if necessary to permit tube replacement. Since the coil assembly 50 conforms closely to the outside surface 38 of the pickup tube 10, the tube is self-centered within the coil assembly. A plurality of optional shims 58 may be disposed between the central support surface 38 of the tube 10 and the coil assembly 50 to aid in centering the tube within the coil assembly. The shims may be located at the forward end of the deflection coils 56 adjacent to the faceplate sealing portion 40 of the tube 10 and also at the rear end of the deflection coils 56 adjacent to the stem sealing portion 42 of the tube 10. The shims 58 may be mechanically secured with split ring clamps (not shown) or with an epoxy resin or equivalent material that can be removed if necessary to permit tube replacement. As herein described, the pickup tube 10 may be precisely aligned within the coil assembly 50 to minimize misregistration and assure proper color operation of a multitubed color camera.

What is claimed is:

1. In a pickup tube of the type including an evacuated tubular envelope having a precisely formed inside surface of a substantially constant inside diameter extending along the length of said envelope, the midpoint of said inside diameter lying on a longitudinally extending first mechanical axis, said envelope being closed at one end by a faceplate and at the other end by a stem section, target means within said envelope adjacent to said faceplate, and electron generating means adjacent to said stem section for generating and directing an electron beam along said first mechanical axis of said tube towards said target means, the improvement wherein said envelope comprises an insulating member with a precisely formed outside surface having a substantially constant outside diameter, said precisely formed outside surface extending along substantially the entire length of said envelope, said outside envelope surface and said inside envelope surface being substantially coaxial to a tolerance of at least 0.0254 mm, the midpoint of said outside diameter lying on a longitudinally extending second mechanical axis which is substantially coincident with said first mechanical axis.

2. In a pickup tube of the type including an evacuated tubular envelope having a precisely formed inside surface of a substantially constant inside diameter extending along the length of said envelope, the midpoint of said inside diameter lying on a longitudinally extending first mechanical axis, said envelope being closed at one end by a faceplate and at the other end by a stem section having a plurality of lead-in connectors extending therethrough, target means within said envelope adjacent to said faceplate, and electron generating means connected to said lead-in connectors extending through said stem section for generating and directing an electron beam along said first mechanical axis of said tube toward said target means, the improvement wherein said envelope comprises an insulating member with a precisely formed outside surface extending along a central portion of said envelope, said precisely formed surface of said central portion having an outside envelope surface that is coaxial with said inside envelope surface to a tolerance of at least 0.0254 mm, the midpoint of said outside diameter of said central portion lying on a longitudinally extending second mechanical axis which is substantially coincident with said first mechanical axis, and said envelope further including a faceplate sealing portion at one end and a stem sealing portion at the other end thereof, each of said envelope sealing portions having an outside diameter less than the outside diameter of said central portion of said envelope.

* * * * *